US005426880A

United States Patent [19]

Ruger et al.

[11] Patent Number: 5,426,880

[45] Date of Patent: Jun. 27, 1995

[54] ELONGATED ELEMENT FOR BIASING THE TRIGGER BAR AND CONTROLLING THE SLIDE STOP LATCH IN AN AUTOMATIC PISTOL

[75] Inventors: William B. Ruger, Croydon, N.H.; James McGarry, Prescott; William T. Atkinson, Prescott Valley, both of Ariz.

[73] Assignee: Sturm, Ruger & Company, Inc., Southport, Conn.

[21] Appl. No.: 133,537

[22] Filed: Oct. 7, 1993

[51] Int. Cl.[6] ..... F41A 17/00

[52] U.S. Cl. ..... 42/69.03; 89/196

[58] Field of Search ..... 42/69.03, 69.02, 69.01; 89/196

[56] References Cited

U.S. PATENT DOCUMENTS

| | | | |
|---|---|---|---|
| 2,600,176 | 6/1952 | Williams | 42/69.03 |
| 4,575,963 | 3/1986 | Ruger et al. | 42/69.03 |
| 4,627,184 | 12/1986 | Ruger et al. | 89/196 |
| 4,681,020 | 7/1987 | Polanecky | 89/196 |
| 4,986,163 | 1/1991 | Tuma | 89/196 |

*Primary Examiner*—David Brown

*Attorney, Agent, or Firm*—Pennie & Edmonds

[57] ABSTRACT

An elongated configured spring which biases the trigger bar of a pistol rearwardly and upwardly and engages the slide top latch to prevent its transverse movement. The spring is anchored in the frame and trigger bar under tension. The spring is long and narrow requiring little space in the firearm.

7 Claims, 4 Drawing Sheets

10
11
12
13
14
15
16
17
17b
17s
115
21
22
23
26
26a
26b
28
28c
2a
3
A 10
11
12
13
14
15
16
17
17a
17b
19
20
21
21a
22
23
26
26a
28
28a
28b
28f
30a
30b
30c
A
2

ELONGATED ELEMENT FOR BIASING THE TRIGGER BAR AND CONTROLLING THE SLIDE STOP LATCH IN AN AUTOMATIC PISTOL

BACKGROUND OF THE INVENTION

Pistols having trigger bars have been biased with a plunger spring arrangement (U.S. Pat. No. 4,575,963). Further, slide stop latches have included slots with retention springs engageable therein (U.S. Pat. No. 4,627,184).

SUMMARY OF THE INVENTION

Broadly, the present invention comprises an elongated configured spring which biases the trigger bar of a pistol having a frame and a slide rearwardly and upwardly and engages grooved slide stop latch to prevent its transverse movement, and to bias the slide stop pin shaft to cause the slide stop to remain against or near the frame during pistol operation.

It is a feature of the invention that the spring element functions to both bias the trigger bar and to bias and control movement of the slide stop latch.

BRIEF DESCRIPTION OF THE INVENTION

DESCRIPTION OF THE PREFERRED EMBODIMENT

Figures 1, 2, 2A, 3:
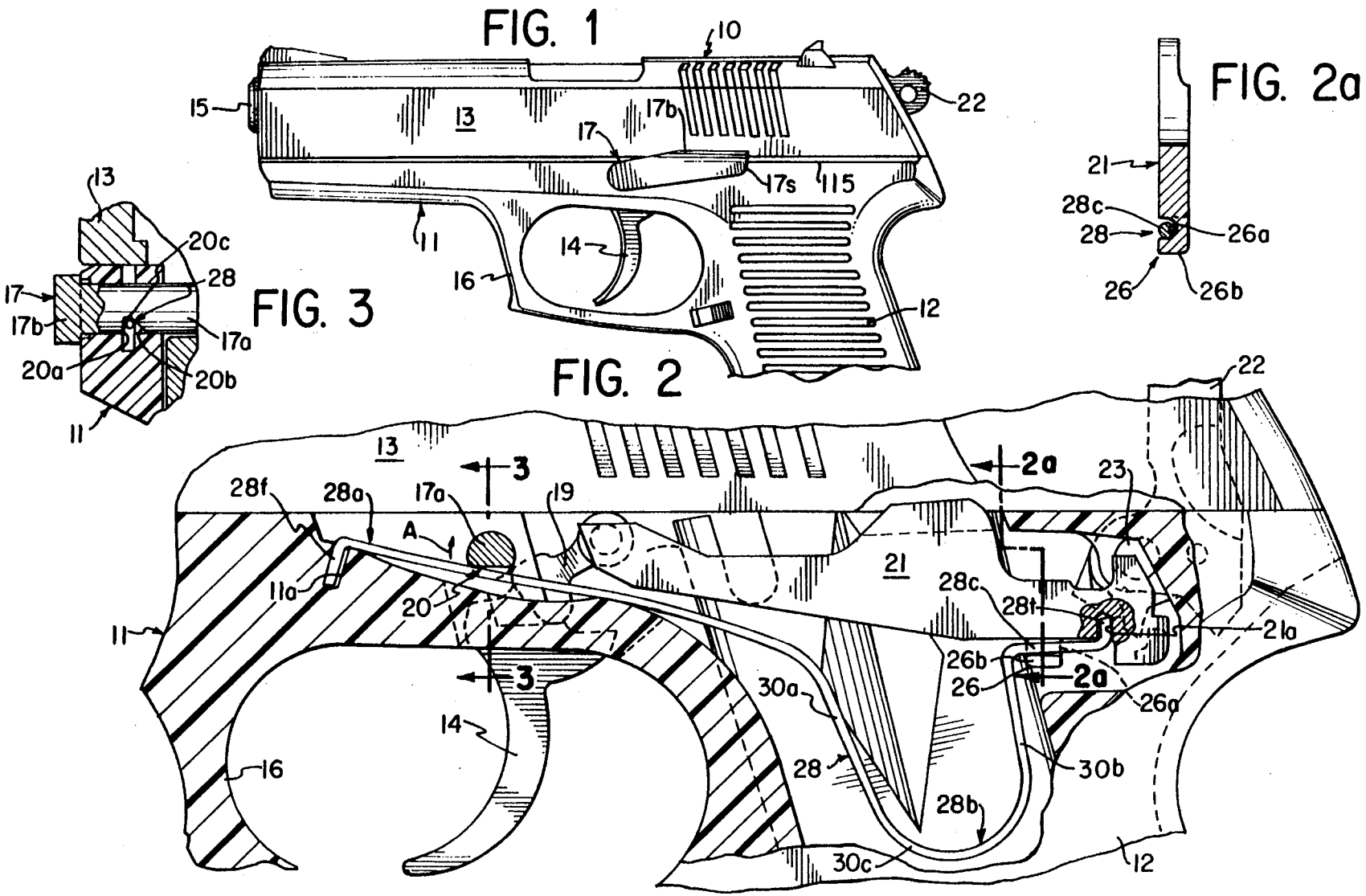
FIG. 1 is a partial side elevational view of the automatic pistol of the present invention.
FIG. 2 is a partial enlarged sectional elevational view along lines 2—2 of FIG. 4 showing frame, slide, trigger bar, stop latch and elongated spring with trigger at rest.
FIG. 2a is a sectional view taken along line 2a—2a of FIG. 2.
FIG. 3 is a sectional view along line 3—3 of FIG. 2.

In FIGS. 1–2, pistol 10 includes frame 11 with upper surface 115, grip 12, slide 13, trigger 14, barrel 15, trigger guard 16 and slide stop latch 17 including pin 17a, thumb piece 17b and thumb piece stop surface 17s (not shown). Thumb piece stop surface 17s is normally urged against frame surface 11s by a spring 28 as further explained. Also shown are trigger extension 19, trigger bar 21, hammer 22 and hammer pivot 23. Trigger bar 21 includes an L-shaped bracket 26 including vertical portion 26a and horizontal portion 26b.

Elongated configured spring 28, which is positioned below trigger bar 21, includes forward end section 28a which is substantially straight except for forward foot 28f; middle loop section 28b and rearward end section 28c which is substantially straight except for tab portion 28t. Middle loop section 28b has two legs 30a, 30b and bottom portion 30c. Foot 28f is mounted in frame hole 11a. Rearward end section 28c is nested in bracket 26 to hold tab 28t in trigger bar hole 21a.

Figures 4, 5:
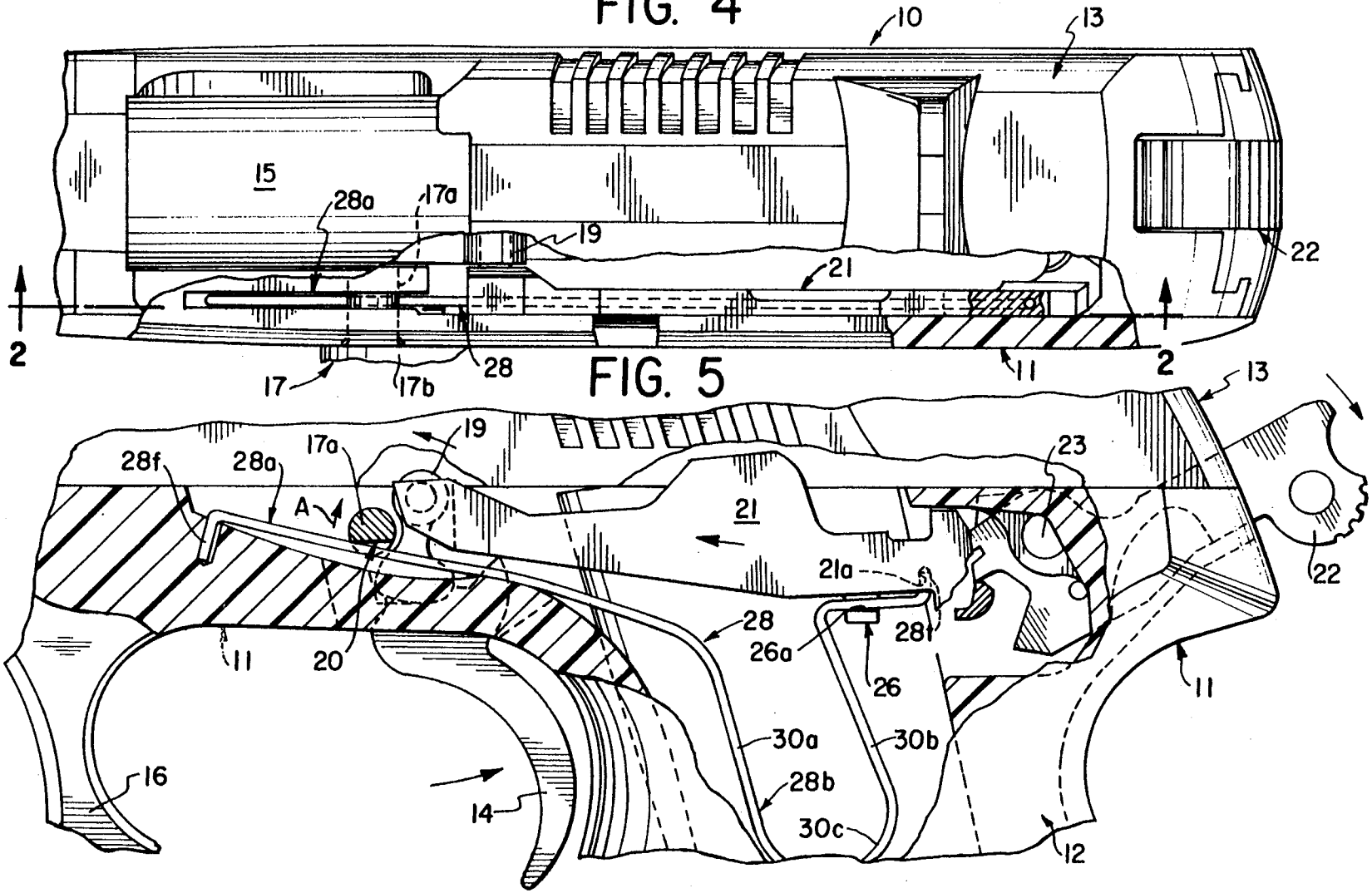
FIG. 4 is a plan view of the pistol with portion cutaway showing the elongated spring and related parts.
FIG. 5 is a view similar to FIG. 2 in which the pistol trigger is in its pulled position.
Figure 6:
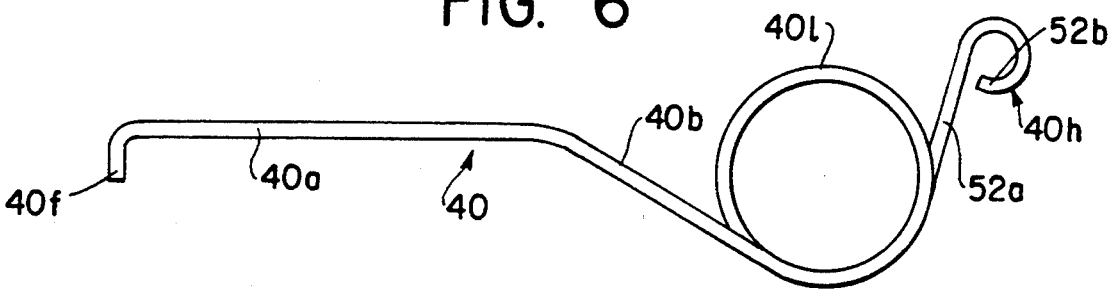
FIG. 6 is an elevational view of an alternative elongated spring including a full circle loop.
Figure 7:
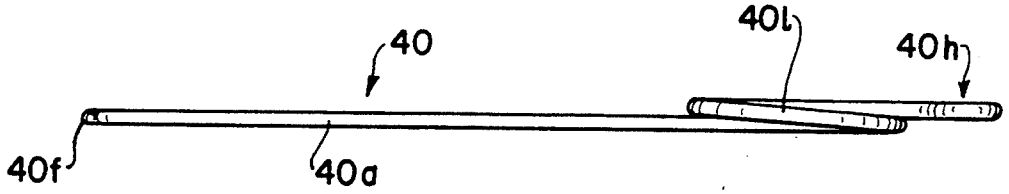
FIG. 7 is a top view of the spring of FIG. 6.
Figure 8:
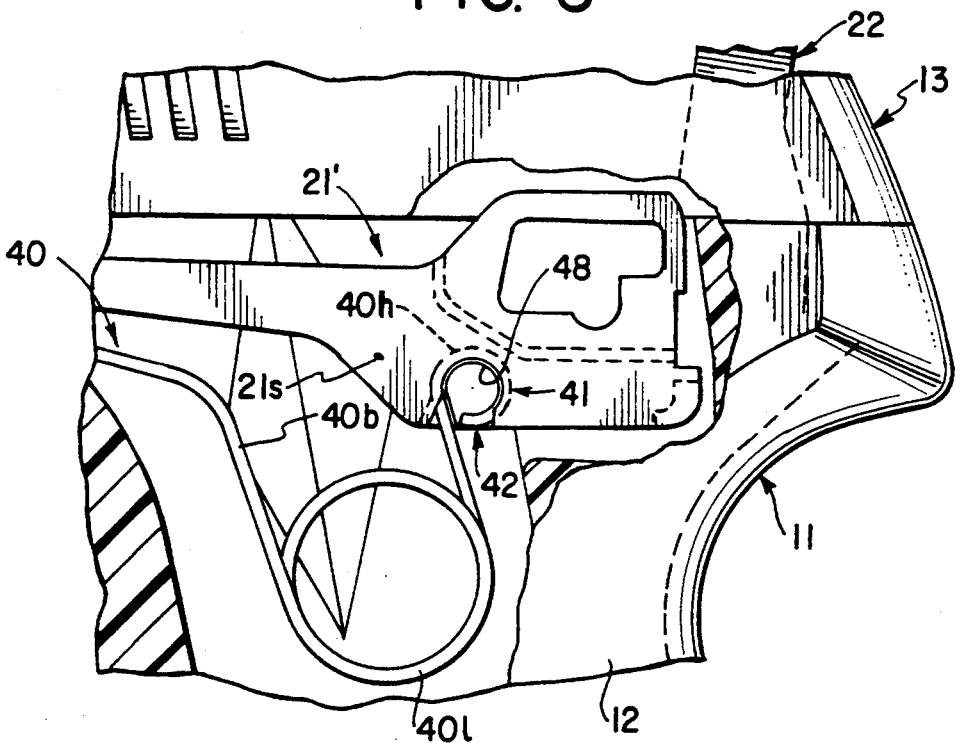
FIG. 8 is a partial elevational view of the rear portion of the trigger bar with the alternative spring mounted therein.
Figure 9:
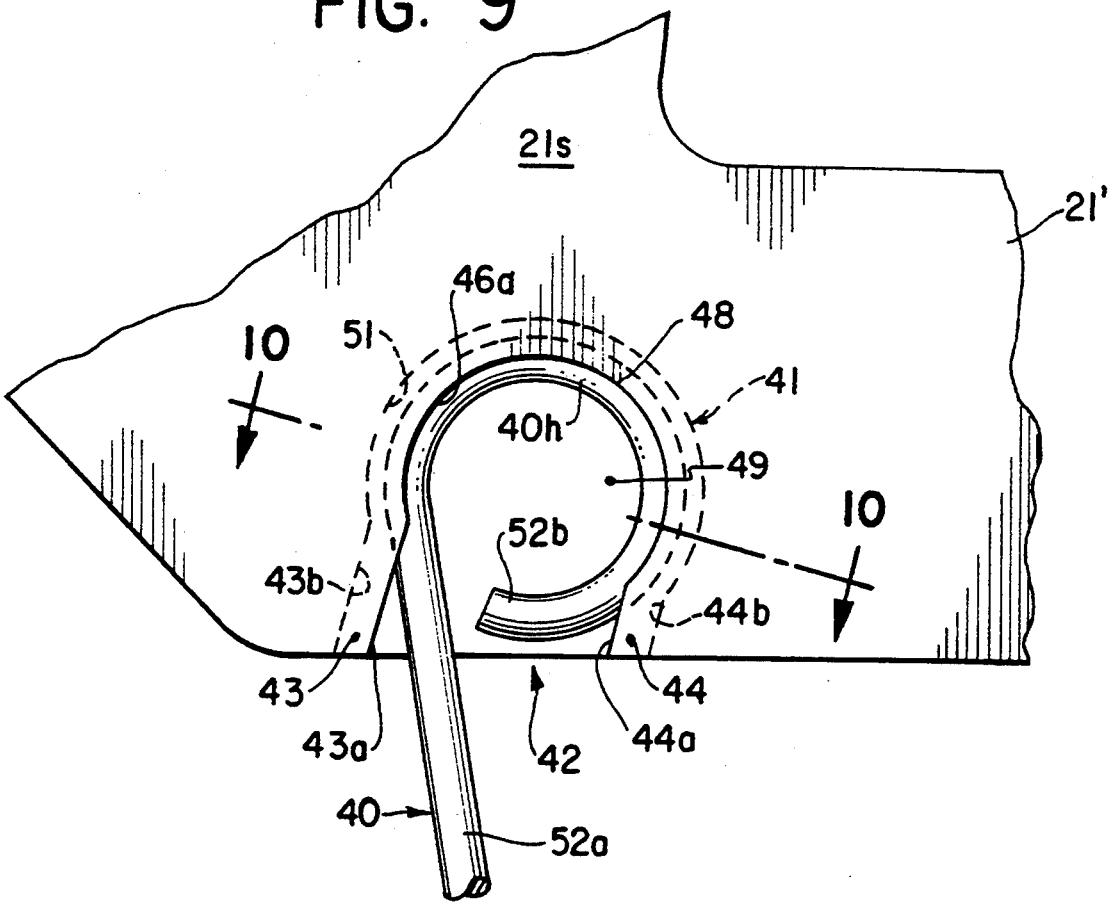
FIG. 9 is an enlarged elevational view of the trigger bar spring rear mount cavity.

Forward end section 28a of spring 28 engages slot 20 of pin 17a to prevent transverse movement of pin 17a and to urge pin 17a in clockwise rotation as viewed in FIG. 2. Slot 20 includes vertical wall 20a and slant wall 20b and slot bottom seat surface 20c (FIG. 3). Spring 28 is shown engaging a portion of seat surface 20c which engagement will bias the pin 17a to rotate clockwise (arrow A) in FIGS. 2 and 5 thus urging thumb piece 17b against frame 11.

Elongated spring 28 is preferably made of spring steel material configured and shaped so that section 28a is urged upwardly into slot 20 and middle loop section 28b compresses with legs 30a, 30b moving toward one another as trigger 14 is pulled and as trigger bar 21 moves forward. Upon release of trigger 14, spring 28 urges trigger bar 21 rearwardly and upwardly. Since spring 28 is long and narrow, it is able to perform the dual functions described while requiring little space.

In pistol operation, spring 28 functions to hold latch shaft pin 17a of latch 17 from transverse movement (movement perpendicular to barrel 15), to bias rotatably bias stop latch 17 and to urge and bias trigger bar 21 rearwardly and upwardly. When trigger 14 is pulled back, trigger bar 21 moves forward tensioning each section 28a, 28b and 28c of spring 28 and particularly loop section 28b.

Figure 10:
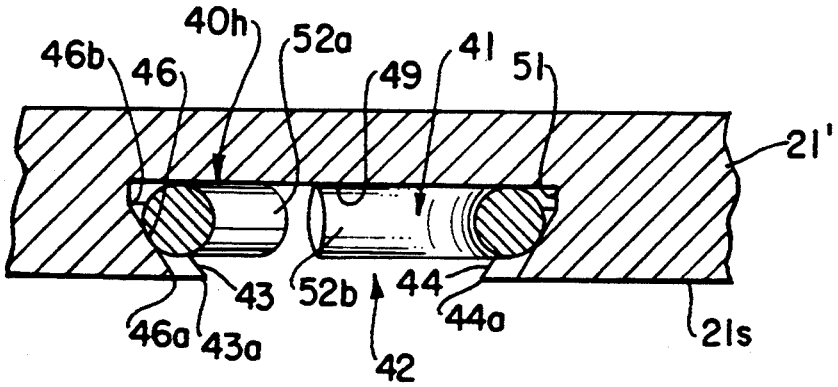
FIG. 10 is a sectional view along line 10—10 of FIG. 9.

An alternative embodiment is shown in FIGS. 6–10 where elongated spring 40 includes forward end 40a, foot 40f, middle section 40b including full circular loop 401 and rearward spring curved head section 40h. Curved head 40h is anchored to trigger bar side cavity 41 in trigger bar 21' which bar has a surface 21s. Cavity 41 includes entrance 42 defined by flat slanting walls 43 and 44. Interior of cavity 41 is defined by a cured slanting wall 46. Flat slanting walls each include an edge 43a, 44a in the plane of surface 21s of bar 21' and an edge 43b, 44b in the interior of bar 21'. Similarly curved slanting wall 46 has edge 46a lying in the surface 21s, and interior edge 46b positioned in the interior of bar 21' (see FIG. 10). In addition cavity 41 has cylindrical section 48 further into the interior of bar 21' defined by edge 46b and cavity floor 49. Cylindrical section 48 has perimeter wall 51 (FIG. 10).

Curved head 40h includes straight leg portion 52a and curved portion 52b which legs are moved toward one another to enable head 40h to be compressed for insertion through cavity entrance 42. Spring foot 40f is anchored in the same manner as the earlier embodiment. As mounted, spring 40 including loop 401 is tensioned to hold it in its anchored position.

In operation of spring 40, head 40h must be compressed for its insertion through entrance 42 into cavity 41. Once head 40h is so installed, leg 52a may due to the shape of entrance 42 be moved forward or backward as loop 401 is tensioned while foot 40f is installed.

We claim:

1. In an automatic pistol having a frame, a slide, a trigger, and a trigger bar connected to the trigger which trigger bar moves forwardly and rearwardly relative to the frame during operation and a slide stop latch including a pin for limiting movement of the slide, means for biasing the trigger bar and engaging the stop latch comprising a) an elongated spring element having a forward end section, a rearward end section, and a middle section with the forward end section positioned in the frame and the rearward end section positioned in trigger bar;

b) first spring mount means on the trigger bar for confining the rearward end of the spring element to urge the rearward end section into and against the trigger bar;

c) second spring mount means on the frame for securing the spring element to the frame;

d) slot means in the stop latch pin for engaging the forward end section of such spring element to prevent transverse movement of such latch.

2. The apparatus of claim 1 in which the first spring mount means is a trigger bar hole and bracket means on the trigger bar which bracket means hold the elongated spring in the trigger bar hole under tension.

3. The apparatus of claim 1 in which the second mount means is a hole in the frame and in which the stop latch holds the elongated spring in such frame hole under tension.

4. The apparatus of claim 1 in which the slot means has a seat means and in which the elongated spring element may engage such seat to rotatably bias the stop latch.

5. The apparatus of claim 1 in which the rearward end section includes a partial curved portion and in which the first spring mount means is a cavity in the trigger bar.

6. The apparatus of claim 1 in which spring element middle section is a full circle loop.

7. The apparatus of claim 1 in which the slot means includes a vertical wall and a slant wall.

* * * * *